US005400900A

United States Patent [19]

Myers et al.

[11] Patent Number: 5,400,900

[45] Date of Patent: Mar. 28, 1995

[54] CLOTHES HANGER SUPPORT, GARMENT BAG HAVING SUCH A SUPPORT, AND METHOD OF MAKING SAME

[75] Inventors: Jay E. Myers, Newport Beach; Dennis L. Grudt, Long Beach; Luis R. Urquidi, Laguna Hills, all of Calif.

[73] Assignee: Andiamo, Inc., Fountain Valley, Calif.

[21] Appl. No.: 23,960

[22] Filed: Feb. 26, 1993

[51] Int. Cl.[6] ..... A45C 5/12; B65D 85/18

[52] U.S. Cl. ..... 206/289; 206/279; 206/290; 190/13 R; 24/513; 211/89; 211/124; 248/316.5; 248/316.6

[58] Field of Search ..... 248/316.5, 316.6; 211/89, 124; 24/513, 516, 517; 190/13 R; 206/291, 293, 279, 289, 290

[56] References Cited

U.S. PATENT DOCUMENTS

| | | | |
|---|---|---|---|
| Re. 31,075 | 11/1982 | London et al. | 206/287 X |
| 1,145,264 | 7/1915 | Pflug | 190/13 R |
| 2,066,646 | 1/1937 | Ritter, Jr. | 190/13 R X |
| 2,596,412 | 5/1952 | Kish, Jr. et al. | 206/287.1 X |
| 2,689,631 | 9/1954 | Marks | 206/287.1 X |
| 2,862,586 | 12/1958 | Davis | 206/287.1 |
| 3,035,673 | 5/1962 | Schenkler | 206/291 X |
| 3,335,826 | 8/1967 | Swirles | 206/287.1 |
| 3,542,170 | 11/1970 | Bialo | 206/287.1 X |
| 3,566,456 | 3/1971 | London | 206/285 X |
| 3,958,675 | 5/1976 | Rosenblum | 206/287.1 |
| 4,193,482 | 3/1980 | Koff | 206/287 |
| 4,363,388 | 12/1982 | London | 206/287 X |
| 4,618,058 | 10/1986 | Mobley et al. | 206/291 |
| 4,640,414 | 2/1987 | Mobley et al. | 206/287 |
| 4,732,270 | 3/1988 | Myers et al. | 206/289 |
| 4,753,342 | 6/1988 | Pulichino, Jr. et al. | 206/291 |
| 4,769,878 | 9/1988 | Liao | 206/291 X |
| 4,782,947 | 11/1988 | Sheiman | 206/279 |
| 4,798,289 | 1/1989 | Mobley | 206/291 X |
| 4,850,562 | 7/1989 | Mazzanti | 206/291 X |
| 4,852,845 | 8/1989 | Lener | 206/291 X |
| 4,858,870 | 8/1989 | Mazzanti | 206/291 X |
| 4,880,113 | 11/1989 | Mobley | 206/287 X |
| 4,907,774 | 3/1990 | Shaw et al. | 206/291 X |
| 5,048,785 | 9/1991 | Shaw et al. | 206/291 X |
| 5,099,989 | 3/1992 | Goodin et al. | 206/291 X |

FOREIGN PATENT DOCUMENTS

| | | | |
|---|---|---|---|
| 156726 | 8/1939 | Australia | 190/109 |

*Primary Examiner*—Sue A. Weaver

*Attorney, Agent, or Firm*—Poms, Smith, Lande & Rose

[57] ABSTRACT

A clothes hanger support for a garment bag or other similar item of luggage includes a depending bracket member pivotally supporting a lower jaw member with hanger-supporting features. A closure member and latch handle cooperates with the bracket and jaw members in a closed position to hold the latter in a hanger-retaining position. Alternatively, the closure member latch handle may be pivoted to allow the jaw member to itself pivot to an open position for insertion or removal of hangers on the support. Pivotal return of the closure member latch handle to the closed position also moves the jaw member to its hanger-retaining position by cooperation of a ramp surface and ramp-follower surface of the closure member latch handle and jaw member, respectively. Preferably, the entire hanger support may be made of four unitary components which are formed of injection molded engineering polymer.

29 Claims, 4 Drawing Sheets

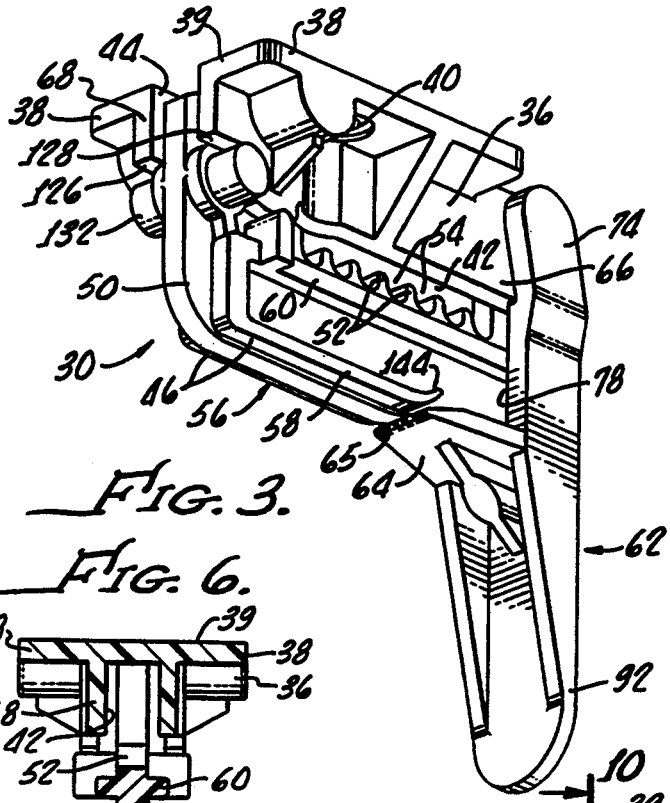
FIG. 3.
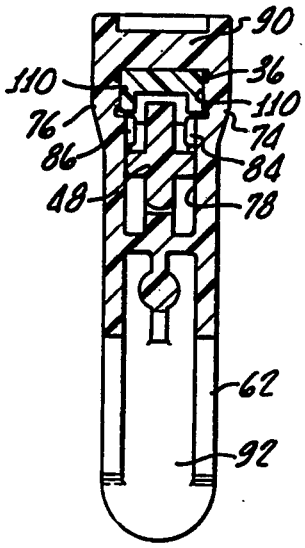
FIG. 5.
FIG. 6.
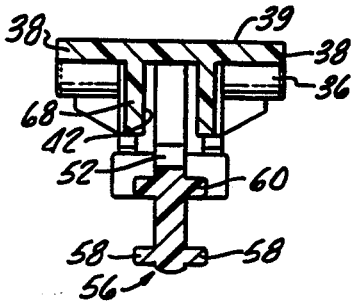
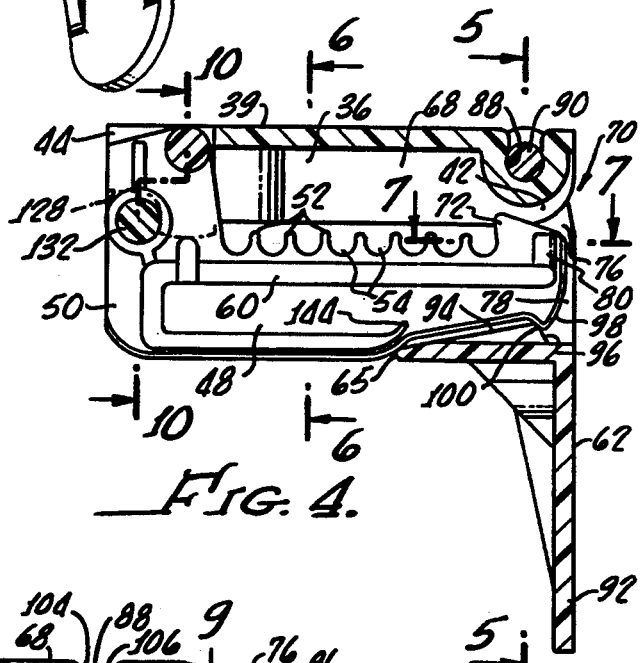
FIG. 4.
FIG. 7.
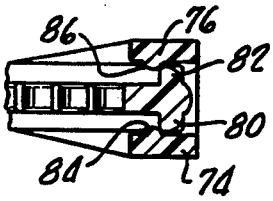
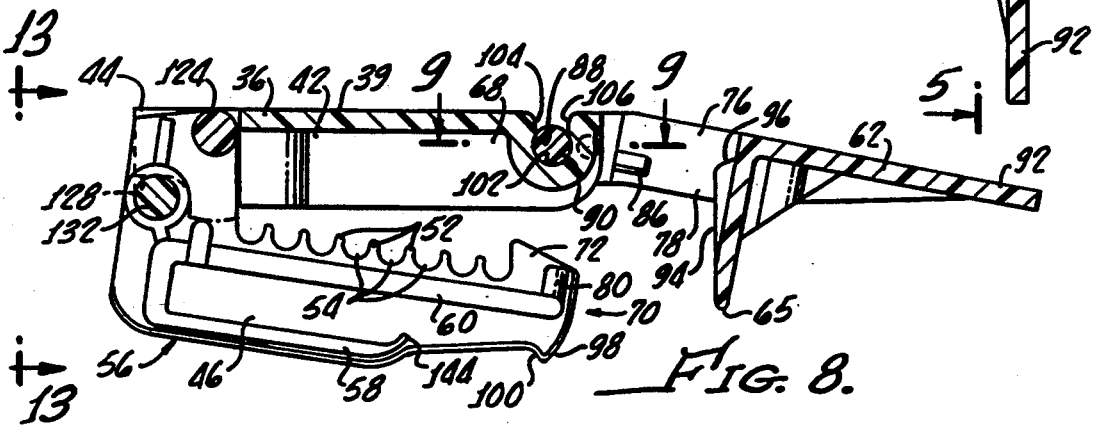
FIG. 8.

FIG. 9.
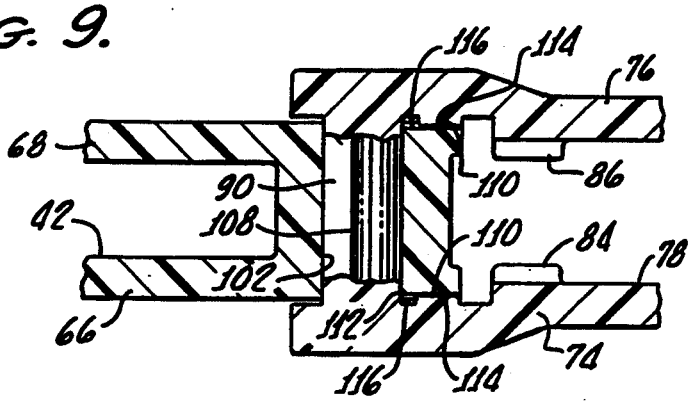
FIG. 10.
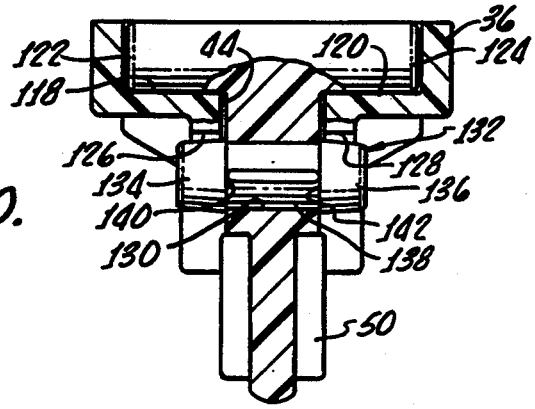
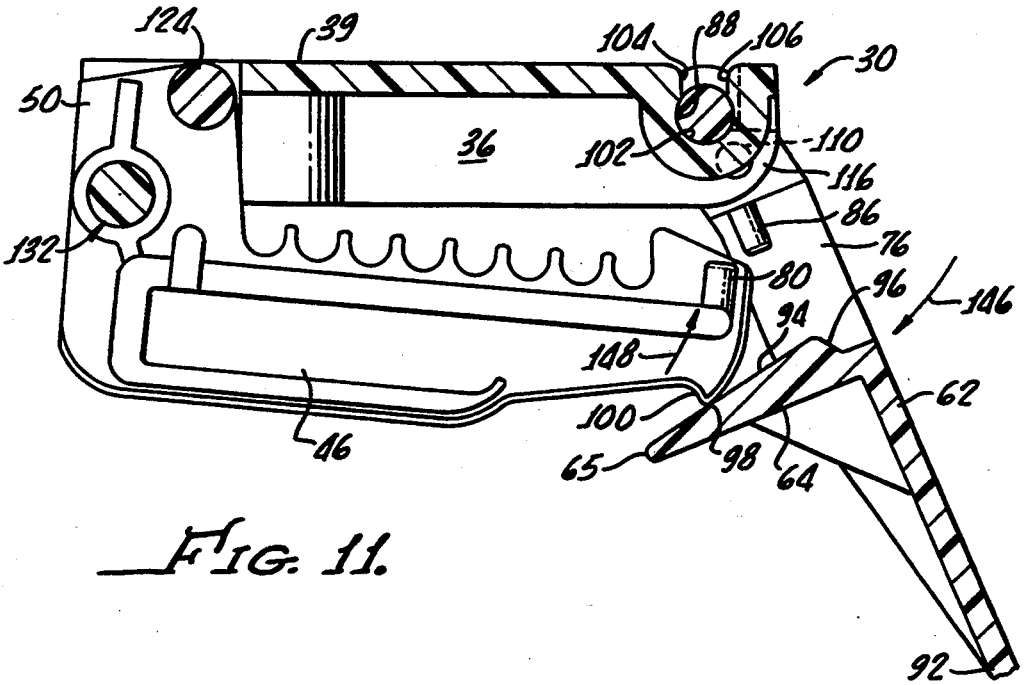
FIG. 11.

FIG. 12.
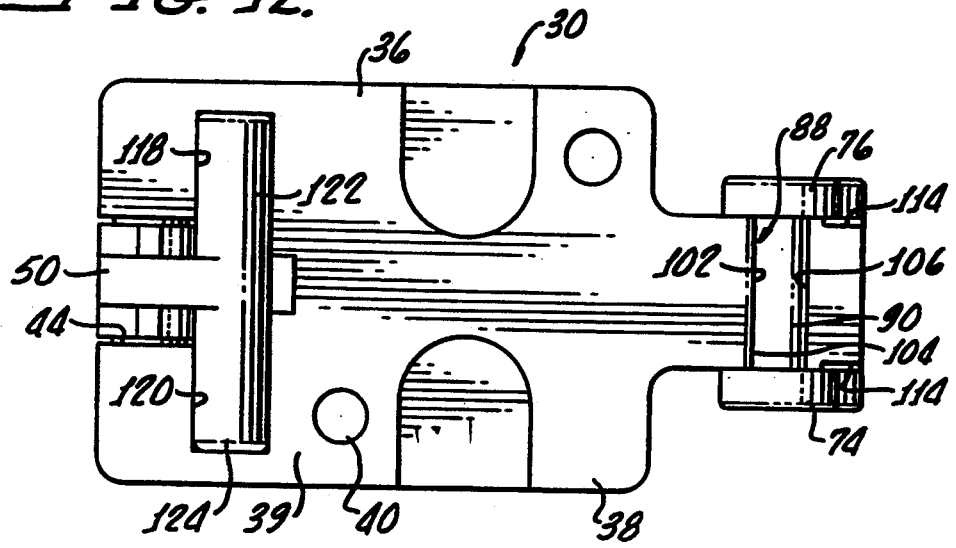
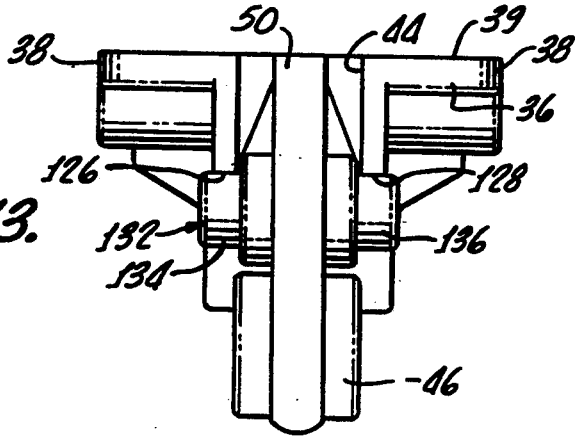
FIG. 13.
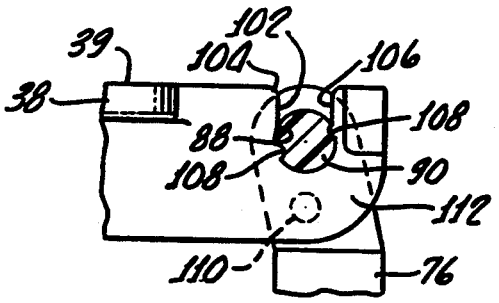
FIG. 14.

CLOTHES HANGER SUPPORT, GARMENT BAG HAVING SUCH A SUPPORT, AND METHOD OF MAKING SAME

FIELD OF THE INVENTION

The present invention relates to clothes hanger supports. More particularly, the present invention relates to a clothes hanger support of the type used within a luggage garment bag, or other item of luggage, and to a garment bag having such a hanger support. A method of making such a clothes hanger support is also disclosed.

BACKGROUND OF THE INVENTION

Conventional luggage garment bags are provided with a clothes hanger support therein by which conventional coat hangers as well as various types of specialized luggage-type coat hangers may be suspended in the garment bag. Known in the art are those hanger supports of W. London, illustrated in U.S. Pat. Nos. 3,566,556; Re 31,075; and 4,363,388, all including a suspended bracket which at on end pivotally supports a corresponding end of a generally horizontal lower element. The lower element is pivotal downward slightly to receive conventional coat hanger hook portions between this lower element and the bracket. A latch device carried at the other end of one of the bracket and lower element cooperates with the other of the bracket and lower element to secure the hanger support in a hanger-retaining operative position.

Also known in the pertinent art are those hanger supports of Greg, et al., and Mobley, assigned to Samsonite Corporation, U.S. Pat. Nos. 4,618,058; 4,798,289; and 4,880,113, all including a generally C-shaped suspended bracket with a pivotal retention member and latch device. The lower arm of the C-shaped bracket can supportingly receive thereon the hook portions of conventional hangers, while the retention member and latch selectively open or close the opening of the C-shaped bracket to allow loading, unloading or retention of the hangers. U.S. Pat. No. 4,769,878, is a variation on the foregoing theme with a C-shaped resilient pad carried within the C-shaped bracket and providing a crenelated lower leg and a cooperative foraminous locally more resilient upper leg for position retention of conventional hangers loaded into the hanger support.

Further, also known in the art are the hanger supports taught by U.S. Pat. Nos. 4,850,562, and 4,852,845, assigned to Lenox, Inc., and both including a generally C-shaped suspended bracket. The lower arm of the bracket provides a support surface for conventional hangers, and cooperates with a pivotal latch device carried adjacent the upper bracket arm for both closing the opening of the C-shaped bracket and retaining hanger hook portions therein.

Finally, the pertinent art also includes U.S. Pat. No. 4,732,270, to Myers, et al., assigned to the same assignee as the present application, and disclosing a hanger support useable with either conventional hangers or with a common variety of luggage-type hanger. In the hanger support of Myers, a suspended bracket pivotally carries an underlying lower jaw member. The jaw member defines a support surface for suspending conventional coat hangers and also carries a depending rail which is engageable by the luggage-type hangers. At aligned ends opposite their pivotal connection, the bracket member and jaw member cooperatively define and carry a latch device for retaining the members in a hanger-retaining relative operative position.

Each of the above-described hanger supports, and others known in the pertinent art, presents a combination of advantages and disadvantages. For example, many of the hanger supports will accept only conventional coat hangers. Yet in some circumstances it is desirable to use the thin, flat luggage-type hangers to allow more clothes to be packed. Frequently, for convenience, and in view of the need to also pack many items of clothing in a piece of luggage, a user will Wish to use both conventional and luggage-type hangers. Only a hanger support according to the Myers patent described above allows a user this flexibility in packing. On the other hand, some of the hanger supports known in the art present other inconveniences in their use. With those hanger supports having a pivotal lower member or jaw, when the hanger support is loaded with clothes on hangers, and is therefore subject to considerable downward weight force if the garment bag is suspended vertically rather than packed in a horizontal position, for example, when the bag is suspended from a door, then the lower member must be physically raised by the user to close the hanger support. This raising of the hanger support lower member or jaw can require considerable force, and can be difficult in view of the limited access to the hanger support afforded by the clothes and hangers already in place on the support. Another common shortcoming in this respect is the disposition of the latch device, or of some part thereof, in an obstructing location of the hanger support. In other words, when the hanger support is open to allow removal of clothing hangers therefrom, or more frequently, to allow insertion of hangers, the latch device is so positioned that it is in the user's way. That is, the latch device may interfere with insertion of hangers into the hanger support, or even more irritatingly, may interfere with both insertion and removal of hangers from the support, so that the hook portion of each hanger must be maneuvered past the latch device onto or from the hanger support.

A further deficiency of conventional hanger supports is that they generally require the fabrication and assembly of many component parts. This multiplicity of component parts increases manufacturing expense, assembly time, chance for error, and opportunity for the hanger support to fail in use by the loosening or disengagement from one another of the plural parts of the assembly.

SUMMARY OF THE INVENTION

In view of the above, the present invention provides a hanger support including a suspended bracket at one end pivotally supporting a jaw member. The jaw member includes a generally horizontal surface for supporting conventional coat hangers, and a depending rail of inverted T-shape for support of luggage-type hangers. Both the jaw horizontal surface and rail include features preventing inadvertent dislodging of a hanger therefrom when the hanger support is in an open operative position. The bracket also pivotally carries a closure handle and latching member, which by its cooperation with the jaw member initially moves the latter from the open hanger-receiving or releasing position to a hanger retention position with a mechanical advantage provided by a leverage, and inclined surface, and thereafter latches the jaw member in the hanger-retaining relative position. In addition, the latching member cooperates with the jaw member to define a weight-responsive detent structure which resists inadvertent opening of the hanger support by clothing weight thereon. Importantly, this closing motion of the hanger support is accomplished with pivotal motion of the closure handle and latching member from an outward position inward of the garment bag with a considerable surface area against which manual closure pressure may be exerted. Access into the loaded garment bag is not required to accomplish closure of the hanger support. The result is an almost effortless closure of the hanger support even when the latter is heavily loaded with clothing. Because this same clothing weight is transferred in part to engaging surfaces of the detent, the weight-responsive latch device is effective to resist any tendency for the support to spring open by weight placed thereon, and to hold the hanger support shut. Both an opening of the latching member and a channel portion of the suspended bracket receive respective portions of the jaw member near the distal end thereof to resist lateral dislocation of this distal end in response to swaying of clothing supported by the hanger support. Consequently, greater strength and reduced chance of support breakage are provided. Also, the suspended bracket and closure handle/latching member cooperate to detent the latter in an extended, nonobstructing position when the hanger support is open to receive or release hangers. In this way, convenience of use is greatly enhanced because the user never has to struggle to maneuver a hanger hook portion past an obstructing latch mechanism.

Importantly, all of the features outlined above are provided by a hanger support comprised of only four unitary pieces, one of which is a simple retention pin cooperating with an abutment to retain two other of the four pieces in cooperation with one another. That is, the features of the present invention are all provided by three major unitary pieces formed preferably of a fiber reinforced engineering polymer (FRP). By advantageous combination, arrangement, and cooperation of surface shapes and other physical features of the four components of the hanger support according to a preferred embodiment of the invention, all of the advantages outlined above are provided in a hanger support which is also more economical in its construction and assembly.

BRIEF DESCRIPTION OF THE DRAWINGS

FIG. 3 presents another perspective view of the hanger support seen in FIG. 2, but taken from a position about ninety degrees leftward (in plan) from the perspective of FIG. 2;

FIG. 4 is a side elevation view, partly in cross section, of the hanger support seen in FIGS. 1–3, and viewed generally in the direction of arrow 4 on FIG. 3;

FIGS. 5–7 are fragmentary cross sectional views taken at the indicated section lines of FIG. 4, and looking in the directions indicated by the section arrows;

FIG. 8 is a side elevation view, partly in cross section, similar to FIG. 4, but showing parts of the hanger support in alternative operative positions;

FIG. 9 is an enlarged fragmentary cross sectional view taken at section line 9—9 of FIG. 8, and illustrating a salient feature of the hanger support embodying the present invention;

FIG. 10 is a fragmentary cross sectional view taken at line 10—10 of FIG. 4;

FIG. 11 is a partly cross sectional view similar to FIG. 8, but depicting parts of the hanger support in alternative operative positions;

FIG. 12 provides a top view of the hanger support;

FIG. 13 is a rear view of the hanger support according to the present invention, taken generally in the direction of the arrows 13—13 of FIG. 8; and FIG. 14 provides a fragmentary side view like FIG. 4 of a forward portion of a hanger support embodying the present invention, and with portions broken away for clarity of illustration.

DETAILED DESCRIPTION OF THE INVENTION

Figure 1:
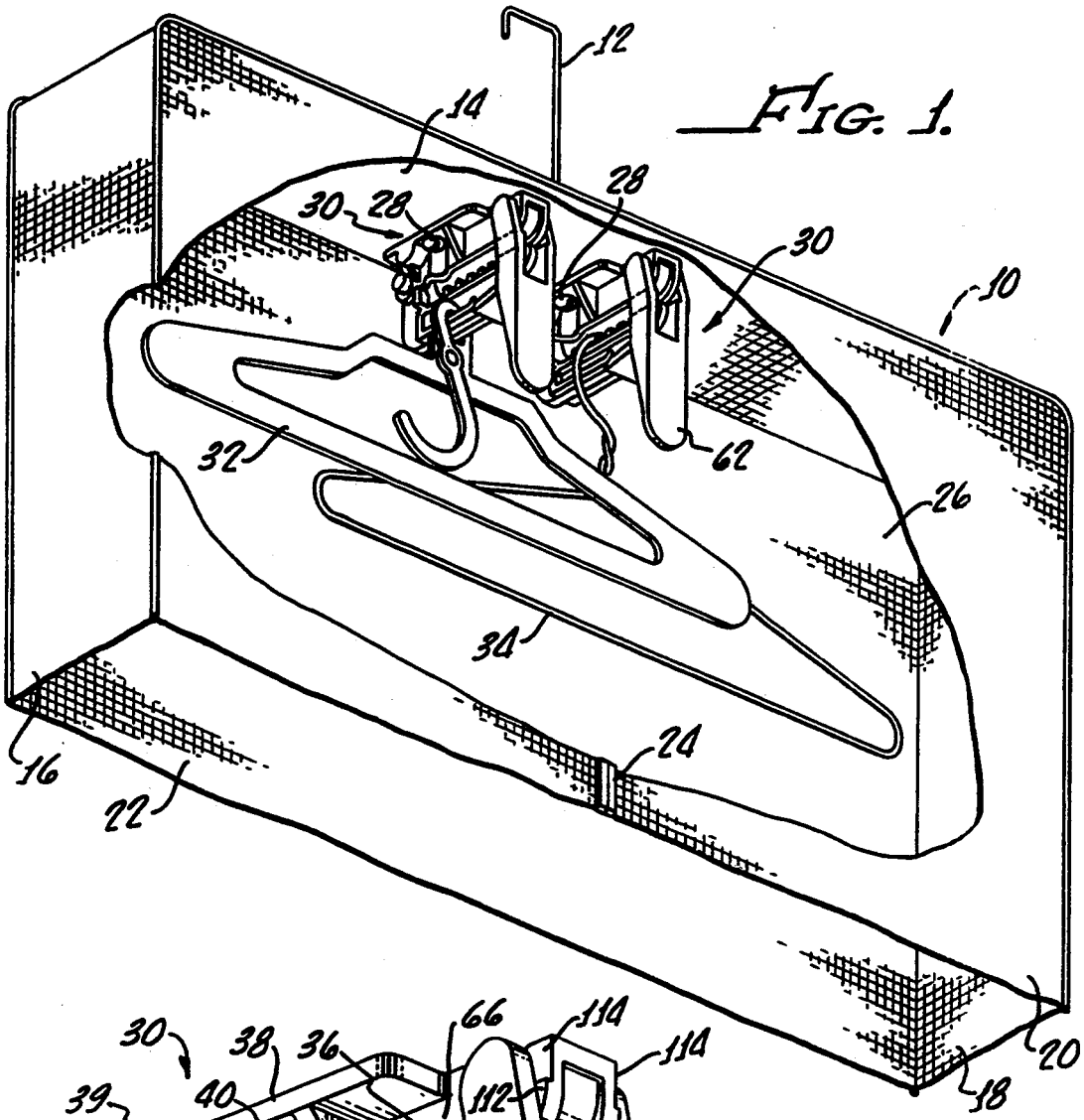
FIG. 1 provides a fragmentary perspective view of a garment bag including a pair of hanger supports embodying the present invention, and having a portion thereof broken away to better illustrate salient features of the present invention.

Viewing FIG. 1, a garment bag 10 includes an upper hook member 12 whereby the bag may be hung from a clothes rod or from the top edge of a door. The bag 10 includes an upper wall 14 to which the hook 12 secures, and from which flexible side walls 16,18, and flexible front and back walls 20,22, respectively, depend. Front wall 20 includes a zippered opening 24 (only a portion of which is visible viewing FIG. 1, and shown in its zipped closed position) providing access to the internal clothes-receiving cavity 26 of the bag 10. The upper wall 14 includes a stiffener or plate (not visible) therein so that this wall is at least in part shape-retaining and load bearing. Internally secured to the wall 14 by fasteners 28 is a pair of identical hanger supports 30. As depicted, the left hand one of the hanger supports 30 is supporting a luggage-type hanger 32, while the right hand hanger support is supporting a conventional wire coat hanger 34.

The hanger supports 30 are preferably fabricated entirely of an injection molded strong shape-retaining, but slightly yieldable, fiber reinforced engineering polymer (FRP). For example, the FRP may be a glass fibre reinforced Nylon 6 material. While considering the following structural description it is important to remember that while the FRP from which the support 30 is fabricated is strong, shape-retaining, and resists creep even under sustained load application, it is also slightly yieldable so that component parts may be "snapped" together and will then be retained in operative positions by the elasticity of the FRP material itself.

Figure 2:
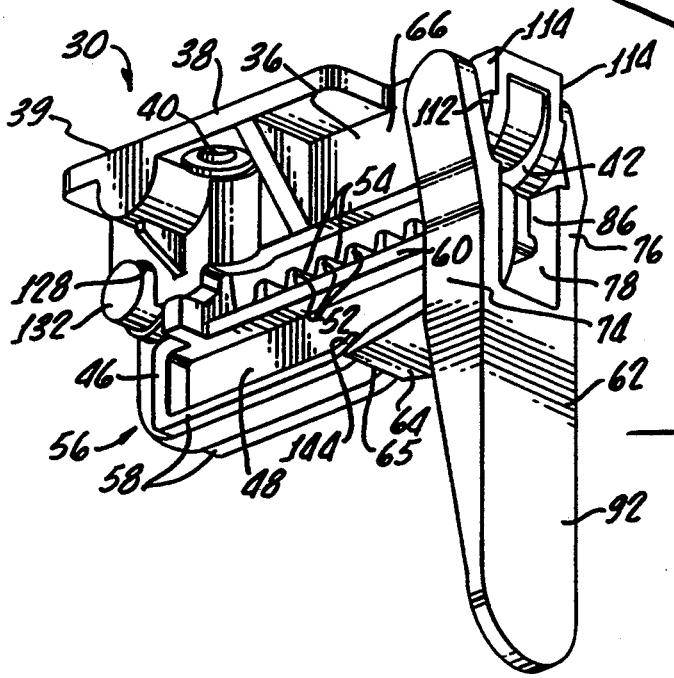
FIG. 2 depicts an enlarged isolated perspective view of a hanger support as it is also seen in FIG. 1.

In order of familiarize the reader with the general structure of the hanger support 30, viewing FIGS. 2 and 3, it will be noted that the support 30 includes a depending bracket member 36, including a pair of laterally extending flanges 38, and the upper surface 39 (best seen in FIG. 12) of which is engageable with the lower inside surface of wall 14. The bracket member 36 at flanges 38 defines through openings 40 for passage of the fasteners 28. Bracket 36 defines a downwardly opening channel 42 extending generally from front to back of the bracket, and at its aft end communicating with a vertically extending notch 44, which is most clearly seen viewing FIG. 3.

Pivotally carried by the bracket 36 adjacent its aft end and received in notch 44 is a generally L-shaped jaw member 46. The jaw member 46 includes a generally horizontally-extending lower arm portion 48 spaced slightly below and confronting the channel 42, and a vertically ascending portion 50 received in notch 44. Arm portion 48 defines spaced crenelations 52 defining laterally spaced apart notches 54 along the top surface thereof, and a depending rail feature 56 of inverted T-section. The notches 54 allow arm 48 to accept and support conventional coat hangers with a wire hook portion, while the flanges 58 of rail feature 56 will accept and support luggage-type hangers, recalling FIG. 1. Because of the cooperation of an upper flange portion 60 of the jaw 46 and the rail feature 56 thereof, the lower arm portion 48 has an I-beam shape in cross section (viewing FIG. 6) and is well able to sustain the weight of clothes on hangers suspended therefrom.

Pivotally carried by bracket 36 near the front end thereof is a dual function closure member and latching handle 62. The handle 62 on the one hand retains the jaw member 36 in an elevated hanger-retaining relative position of cooperation with bracket member 36, to capture wire coat hangers thereon, as depicted, and on the other hand includes an extending tooth portion 64 aligning with the lower flanges 58 of rail feature 56 to retain luggage-type hangers thereon.

In order to point out significant functional advantages which result from static structural cooperation when the hanger support 30 is in its hanger-retaining condition depicted in FIGS. 1–4, the reader is directed particularly now FIGS. 4–14 in conjunction, with attention first to FIG. 4, and recalling FIGS. 2 and 3. Viewing these FIGS., it is seen that the bracket member 36 includes a pair of laterally spaced depending walls 66,68 cooperating to define the channel 42. At a distal or front end 70 thereof, the jaw member 46 includes an ascending portion 72 which is received in channel 42 between the walls 66,68, with a slight clearance. In response to lateral forces as may result from swaying of clothes in bag 10, the portion 72 is engageable with the walls 66,68 to be laterally supported thereby in resisting lateral displacement of the distal end 70. To similar effect, the handle portion 62 includes a pair of depending bar portions 74, 76 which lie on either side of the walls 66,68 and cooperate to define an opening 78, viewing FIGS. 2 and 3, receiving the distal end 70 of jaw member 46. The flange 60 of Jaw 46 is closely received in opening 78 with slight lateral clearance to be further supported by bar portions 74,76 in response to lateral forces.

Further, adjacent the distal end of flange 60, the jaw member 46 includes a pair of opposite upstanding ribs 80,82. The bar portions 74,76 of the latch handle 62 define a pair of confronting ribs 84,86 on opposite sides of the opening 78, and in the depicted position of the handle portion 62 (still viewing FIG. 4, and with reference to FIGS. 7 and 8), these ribs engage in interfering relation with the ribs 80,82. Thus, the handle 62 and jaw member 46 cooperatively define a first detent by cooperation of ribs 80, 82, 84, and 86 to retain the handle and jaw member selectively but disengageably in the relative positions depicted in FIGS. 2–7. That is, because of the slight elasticity of the FRP material, the jaw and handle members are sufficiently yieldable to allow ribs 80,82 to move past ribs 84,86. Thus the handle member 62 may be pivoted rightwardly and upwardly from its position seen in FIG. 4 to the position depicted in FIG. 8.

In order to pivotally support the handle 62 on the bracket member 36, the latter defines a transverse upper groove 88, the structural details of which will be more fully explained below. Spanning the upper ends of the bars 74,76 the handle 62 includes an integral pin portion 90. Pin portion 90 is generally, but not perfectly, round in cross section to be pivotally received into the groove 88. The significance of the noncircularity of pin 90 will be explained below in conjunction with the explanation of the structural details of the groove 88 defined by bracket 36. Below the tooth portion 64, handle 62 includes a manually engageable lower handle portion 92 by which the handle may be placed into and removed from the operative position depicted in FIGS. 2–4.

Consideration of the hanger support 10 in its operative position depicted if FIGS. 2–4 will readily lead to an appreciation that wire coat hangers placed at their hook portions into the notches 54 are retained therein, are suspended by arm portion 48, and that none of the hangers can escape because of ascending portion 72 and handle 62. Ordinarily, and depending on the size of wire from which a hanger is made, it may be captured in a notch 54 by the bracket 36, and will be unable to escape past the adjacent crenelations. On the other hand, should a user of the hanger support 30 use hangers of small gauge wire, these may be movable fore and aft on the arm 48 from notch to notch when, for example, the garment bag is so oriented that clothing weight does not retain the hangers in the notches at their hook portions. In these circumstances, the ascending portion 72 and handle 62 are effective to retain the hangers in the hanger support 30. Similarly, luggage-type hangers placed upon the inverted T-shaped rail feature 56 are retained thereon by the cooperating tooth portion 64 of handle 62. That is, the tooth portion 64 defines an end edge abutment surface 65 confronting and engageable by the luggage-type hangers to prevent their escape from the rail 56.

Further consideration of FIG. 4 will reveal that the handle portion 62 also defines a ramp surface section 94 extending and ascending along the tooth portion 64 thereof from the free end of the tooth portion and into the opening 78. The ramp surface portion 94 leads to a descending back surface portion 96 which slopes in the opposite direction. Similarly, the lower arm portion 48 of jaw member 46 at 98 defines a ramp-follower surface confronting and engageable with the ramp surface 94 of the handle 62 in a cooperative relative position of these components which will be described. The ramp-follower surface portion leads to a descending detent surface portion 100, which in the relative positions of the handle member and Jaw member depicted in FIG. 4, confront and are engageable with one another to define a second detent which is weight-responsive. That is, when clothes on hangers are suspended from the hanger support 30, the weight of these hangers bearing downwardly on the arm 48 of jaw member 46 forces the surfaces 96 and 100 into engagement with one another. The slope of these detent surfaces is such that any tendency of the hanger support 30 to spring open under weight is completely canceled, and the handle portion 62 is in fact held firmly closed by the very weight loading on the hanger support which otherwise might spring it open. Also of importance is the vertically downward alignment of the weight force effective on handle 62 as transferred from jaw 46. In other words, this weight force is vertically downward and is aligned radially with respect to the pin portion 90 of the handle 62. Thus again, there is no tendency for this weight force to produce an opening moment on the handle 62, which moment might pop open the hanger support 30. However, this weight-responsive detent action effective on the handle 62 is easily overcome manually when a user of the garment bag desires to open the hanger support 30, as is described below.

When it is desired to place into or remove hangers from the hanger support 30, the handle 62 is manually pivoted from the position depicted in FIGS. 2–4, to the position shown in FIGS. 8 and 9. Attention now to FIG. 8 and the details of FIGS. 9 and 14, will show that transverse groove 88 of bracket member 36 includes a semicircular groove portion 102 opening upward between two confronting shoulders 104,106, which are spaced apart by less than the diameter of groove portion 102 and pin 90. In order to snap pin 90 into the groove portion 102, the pin includes a pair of diametrically opposed and length-wise extending recesses or grooves (only one of which is visible in FIG. 9), referenced with the numeral 108, extending along the entire length of the pin between bar portions 74,76. By alignment of the grooves 108 between the shoulders 104,106, and with the slight yieldability of the FRP material, the pin 90 can be forcefully introduced into the groove portion 102. Further, each of the bar portions 74,76 of the handle member 62 defines a small circular pad 110 protruding into the opening 78 adjacent to pin portion 90. The pads 110 slidably engage an outside surface 112 (which is best seen in FIG. 14) of the bracket in the pivotal position of handle 62 depicted in FIG. 4. However, the bracket member 36 defines a pair of opposite recesses 114,116 (one of which is seen in FIG. 14) into which the pads 110 are received when the handle 62 is placed into the open position depicted in FIG. 8. By virtue of the elasticity of the FRP material, pads 110 with recesses 114,116 define a position-retaining detent for handle 62. Thus, when the hanger support 30 is open for insertion or removal of hangers, the handle member 62 essentially supports itself upwardly and out of the user's way. Also, the pads 110 frictionally engage the surface 112 with sufficient force to support the handle 62 in an extended position similar to that depicted in FIG. 8, but short of the detent position. That is, if the user of a garment bag opens the support 30, but fails to place the handle 62 in its detented position depicted by FIG. 8, the handle 62 will nevertheless not flop down into the user's way because the pads 110 frictionally engage the surface 112 with sufficient force to hold the handle where the user places it.

Also shown by FIG. 8 is the open position of the jaw member 46. In this open position, the arm portion 48 drops down slightly away at its distal end from the bracket member 36. In order to pivotally support the jaw member on bracket member 36, the latter defines a pair of laterally aligned recesses 118,120 communicating with the notch 44 and opening upwardly on the bracket 36 (viewing FIGS. 10 and 12). Cooperatively, the jaw member 46 includes a pair of integral oppositely extending trunnion pins 122,124 pivotally received into the recesses 118,120. The bracket member 36 also defines a pair of abutment surfaces 126,128 (best seen in FIGS. 3, 10, and 13), one on each side of the notch 44. Ascending arm portion 50, of the jaw member 46 defines,a transverse bore 130 wherein is received pin 132 cooperably engageable with the abutments 126,128. As is seen in FIG. 11, the pin 124 includes a pair of head portions 134,136, the latter of which is slightly tapering from a smaller diameter free end of the pin to a larger diameter spaced from this end. Pin 124 also includes a reduced diameter central portion 138 cooperating with the head portions to define a pair of opposed shoulders 140,142. Because of the taper of the head portion 136, and the slight yieldability of the FRP material from which the hanger support is fabricated, the pin 132 may be forced partially through the bore 130, after the jaw member 46 is engaged at pins 122,124 within the recesses 118,120. Thus, the hanger support can be opened to the position depicted by FIG. 8 for removal and insertion of hangers thereon. Head portions 134,136 engage abutments 126,128 to support the jaw member 46. The cooperation of pins 122,124, in recesses 118,120, and of pin 132 with abutment surfaces 126,128, is sufficient to support the Jaw member in the position depicted in FIG. 8 even with a heavy load of clothes and hangers suspended therefrom.

Importantly, each of the distal ends of flanges 58 include upturned termination portions 144, so that luggage-type hangers on the rail feature 56 will not inadvertently slide therefrom. That is, the slight downward slope of the rail feature 56 in the open operative position of the hanger support 30, which otherwise might result in luggage-type hangers sliding from the rail as a user if loading or unloading the garment bag, is prevented from having this undesirable result.

Once the hanger support 30 is loaded with clothes on hangers, closure of the support from the open position of FIG. 8 to the hanger-retaining position depicted in FIGS. 2–4 can easily be effected without any need for the user to physically lift the jaw member 46, and the clothes suspended thereon. FIG. 11 depicts the cooperation of the ramp surface 94 and ramp-follower surface 98 of the handle member 62 and jaw member 46 as the former is moved from its position of FIG. 8 toward the position depicted in FIGS. 2–4. Because of the leverage provided by handle portion 92, the considerable surface area thereof against which manual pressure may be exerted (arrow 146), as well as the considerable mechanical advantage of the ramp surface section 94 (arrow 148), the jaw member 46 can easily be moved to its position of FIGS. 2–4 even when heavily loaded with clothes.

Those skilled in the pertinent art will recognize that the present invention provides a convenient, rugged hanger support, which also by advantageous combination, arrangement, and cooperation of structural features on a total of only four monolithic components, may be fabricated of injection molded FRP. The inventive hanger support can be assembled without tools, or with only very simple and inexpensive tools, to result in a uniquely low cost of manufacture and assembly, while providing a combination of structural and functional features not heretofore available.

The foregoing detailed description is to be clearly understood as given by way of illustration and example only, the spirit and scope of this invention being limited solely by the appended claims.

What is claimed is:

1. A clothes hanger support comprising a depending bracket member, a jaw member pivotal on said bracket member adjacent one end of the latter and having a hanger-supporting arm in a first position generally horizontally disposed below said bracket member, and a handle member pivotal on said bracket member adjacent an opposite end of the latter, said bracket member and said jaw member defining cooperating means for in a second position providing cantilever support of the latter with said hanger-supporting arm pivotally inclined, and said handle member and jaw member defining cooperating means for moving the latter from said second to said first position in response to pivoting of said handle member between respective first and second locations.

2. The invention of claim 1 wherein said cooperating means includes said handle member carrying a ramp surface cooperable with a ramp follower surface of said jaw member to move the latter to said first position in response to pivotal movement of said handle member.

3. The invention of claim 2 wherein said handle member and said jaw member define cooperating detent means for retaining the latter in said first position.

4. The invention of claim 3 wherein said detent means is responsive to hanger weight on said jaw member to proportionately detain the latter in said first position.

5. The invention of claim 4 wherein said detent means includes said ramp surface leading to a back surface of opposite inclination, said ramp follower surface similarly leading to a detent surface also inclined oppositely thereto, and said detent surface being engageable with said back surface in said first jaw position in response to weight on the latter.

6. The invention of claim 3 wherein said detent means includes both said jaw member and said handle member each defining one of a pair of lateral protrusions, each one of said pair of lateral protrusions of said law member and said handle member yieldably interfering with the other one of said pair of protrusions in said first position of said jaw member.

7. The invention of claim 3 wherein said hanger support further includes second detent means for in a third location of said handle member retaining the latter in generally pivotal elevation in alignment with said bracket member.

8. The invention of claim 7 wherein said second detent means includes said handle member defining a lateral pad protrusion slidably engageable with said bracket member, and said bracket member defining a recess receiving said pad protrusion in said third location of said handle member.

9. The invention of claim 1 wherein said jaw member further includes a luggage-hanger rail of generally inverted T-shape in cross section dependant below said hanger-supporting arm.

10. The invention of claim 9 wherein said hanger-supporting arm is generally of I-shape in cross section to include a pair of oppositely extending lower flanges defining said luggage-hanger rail.

11. The invention of claim 10 wherein said lower flanges include an upturned distal termination portion effective in said second position of said jaw member to retain a luggage hanger thereon.

12. The invention of claim 10 wherein said handle member further includes an extending tooth portion which in said first location of said handle member confronts said luggage-hanger rail to capture luggage hangers thereon.

13. The invention of claim 1 wherein said bracket member and jaw member cooperatively define engaging abutment means for supporting the latter in said second position.

14. The invention of claim 13 wherein said engaging abutment means includes said bracket member defining a pair of abutment surfaces one on either side of said jaw member, and said jaw member carrying a transverse pin member which at projecting end portions thereof engages said abutment surfaces in said second position of said jaw member.

15. The invention of claim 14 wherein said jaw member is fabricated of a shape-retaining yieldable material and defines a transverse bore, said transverse pin member including a pair of head portions one of which tapers with increasing diameter from a free end of said pin member, and a central portion of smaller diameter cooperating with said head portions to define a pair of shoulders, whereby said pin member may be introduced forcefully into said bore, tapered head portion first, and moved therein to dispose said central pin portion in said bore with said shoulders confronting said jaw member to capture said pin member therein.

16. The invention of claim 1 wherein said hanger support is composed entirely of said bracket member, said jaw member, and said handle member, each of which is a unitary body; and said cooperating means for in a second position providing cantilever support of said law member including an abutment member carried by said jaw member and cooperating with said bracket member in said second position of said jaw member to support the latter.

17. A garment bag including a clothes hanger support according to claim 1.

18. A clothes hanger support comprising:

a bracket member having an upper lateral flange portion and an elongate depending channel portion;

a generally elongate jaw member, means for attachment of said jaw member on said bracket member at one end of the latter to dispose a generally horizontal hanger-supporting arm portion of said jaw member below and in a first position in confronting generally parallel relation with said channel portion of said bracket member, and in a second position wherein said hanger-supporting arm portion is angularly spaced from said channel; and a manually-operable closure member handle, means for pivotal attachment of said closure member handle on said bracket member at another end thereof and in a first location cooperating with said jaw member to retain the latter in said first position, said jaw member and said handle member further defining cooperating means for in a respective second location of the latter engaging and moving said jaw member from said second position to said first position in response to manual movement of said handle member to said first location.

19. The invention of claim 18 wherein said jaw member includes a luggage-hanger rail feature of inverted T-shape in cross-section dependent from said hanger-supporting arm portion.

20. The invention of claim 19 wherein said luggage-hanger rail feature includes a pair of laterally extending flanges extending along a length of said jaw member hanger-supporting arm portion, said flanges including termination portions disposed toward a distal end of said jaw member and which turn upwardly, whereby in said second position of said jaw member with the latter pivoted downwardly at said distal end below said bracket member luggage-type hangers resident upon said rail feature will not slide therefrom by their own weight.

21. The invention of claim 20 wherein said closure member handle further includes an extending tooth portion which in said first position and location of said jaw member and handle member, respectively, aligns with said luggage-hanger rail feature to capture luggage-type hangers resident thereon.

22. The invention of claim 20 wherein said jaw member includes an ascending distal portion receivable into said channel portion with said jaw member in said first position thereof.

23. The invention of claim 22 wherein said jaw member ascending portion further cooperates laterally with a pair of dependent wall portions of said bracket member, which wall portions define said channel portion, and thereby resists lateral dislocation of said jaw member distal end.

24. The invention of claim 18 wherein said closure member handle includes a pair of bar portions straddling said bracket member at said another end thereof, said bar portions cooperatively defining an opening in said closure member handle, and said jaw member including a laterally extending flange portion which in said first position of said handle is received at a distal end of said closure member handle into said opening of said closure member handle for lateral support by said pair of bar portions.

25. The invention of claim 24 wherein said closure member handle also defines a pair of inwardly projecting first ribs at said opening, said jaw member including a pair of outwardly extending second ribs adjacent said distal end of said jaw member, and said first and second ribs interferingly engaging one another to detent said handle member in said first location thereof.

26. The invention of claim 26 wherein said jaw member and said closure member handle further include cooperating inclined surface means engageable one with the other in response to weight on said hanger-supporting arm portion to detent said jaw member and handle in said first position and location, respectively.

27. The invention of claim 18 wherein said engaging and moving cooperating means includes said closure member handle defining a ramp surface, said jaw member defining a ramp follower surface engageable in said second handle location with said ramp surface.

28. The invention of claim 27 wherein said ramp surface and said ramp follower surface each lead to a respective one of said inclined surface means.

29. A garment bag including a clothes hanger support according to claim 18.

* * * * *